US010185267B2

(12) United States Patent
Shoji

(10) Patent No.: US 10,185,267 B2
(45) Date of Patent: Jan. 22, 2019

(54) INTEGRATED SENSOR AND IMAGE FORMING APPARATUS THEREWITH

(71) Applicant: KYOCERA Document Solutions Inc., Osaka (JP)

(72) Inventor: Haruki Shoji, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 15/865,980

(22) Filed: Jan. 9, 2018

(65) Prior Publication Data

US 2018/0210386 A1 Jul. 26, 2018

(30) Foreign Application Priority Data

Jan. 20, 2017 (JP) ..... 2017-008027

(51) Int. Cl.
*G03G 15/00* (2006.01)
*G03G 15/01* (2006.01)
*G03G 15/08* (2006.01)

(52) U.S. Cl.
CPC ..... *G03G 15/5041* (2013.01); *G03G 15/0194* (2013.01); *G03G 15/0856* (2013.01); *G03G 2215/00042* (2013.01); *G03G 2215/00059* (2013.01); *G03G 2215/00063* (2013.01)

(58) Field of Classification Search
CPC ..... G03G 15/5041; G03G 15/0856; G03G 2215/00042; G03G 2215/00037; G03G 2215/00059; G03G 2215/00063; G03G 2215/00029; G03G 15/5058; G03G 2215/00616; G03G 2215/00632; G03G 15/065
See application file for complete search history.

(56) References Cited

U.S. PATENT DOCUMENTS 7,020,404 B2 * 3/2006 Fukuda ..... G03G 15/5058 399/49
2003/0052958 A1 * 3/2003 Shinohara ..... G03G 15/5058 347/116
2006/0008284 A1 * 1/2006 Ushijima ..... G03G 15/5037 399/48
2007/0170925 A1 * 7/2007 Kandori ..... G03G 15/5037 324/457
2011/0058823 A1 * 3/2011 Hirai ..... G03G 15/5058 399/15
2012/0045237 A1 * 2/2012 Aoki ..... G03G 15/1675 399/66
2012/0237246 A1 * 9/2012 Taishi ..... G03G 15/5058 399/74

FOREIGN PATENT DOCUMENTS

JP 2016-75813 A 5/2016

* cited by examiner

*Primary Examiner* — Sandra Brase
(74) *Attorney, Agent, or Firm* — Stein IP, LLC

(57) ABSTRACT

An integrated sensor has a density detection sensor, a sensor board, and a potential sensor pattern. The density detection sensor detects the density of a toner image formed on a toner image carrying member. On the sensor board, the density detection sensor is mounted. The potential sensor pattern is provided on the sensor board, and detects the potential of the toner image.

9 Claims, 8 Drawing Sheets

INTEGRATED SENSOR AND IMAGE FORMING APPARATUS THEREWITH

INCORPORATION BY REFERENCE

This application is based upon and claims the benefit of priority from the corresponding Japanese Patent Application No. 2017-008027 filed on Jan. 20, 2017, the entire contents of which are incorporated herein by reference.

BACKGROUND

The present disclosure relates to an integrated sensor and an image forming apparatus incorporating the integrated sensor. More particularly, the present disclosure relates to an integrated sensor that can detect the density and the potential of a toner image and to an image forming apparatus incorporating such an integrated sensor.

Conventional image forming apparatuses incorporating a developing device which uses two-component developer containing toner and carrier are configured to perform developing by consuming toner. The ratio of toner to carrier (T/C) in the developing device affects the amount of electrostatic charge of toner, and thus needs to be kept constant. To that end, a toner density sensor (toner density detecting portion) which detects the ratio of toner to carrier in the developing device is provided to supply toner based on the result of detection by the toner density sensor.

SUMMARY

According to one aspect of the present disclosure, an integrated sensor includes a density detection sensor, a sensor board, and a potential sensor pattern. The density detection sensor detects the density of a toner image formed on a toner image carrying member. On the sensor board, the density detection sensor is mounted. The potential sensor pattern is provided on the sensor board, and detects the potential of the toner image.

Further features and advantages of the present disclosure will become apparent from the description of embodiments given below.

DETAILED DESCRIPTION

Hereinafter, embodiments of the present disclosure will be described with reference to the accompanying drawings.

First Embodiment

Figure 1:
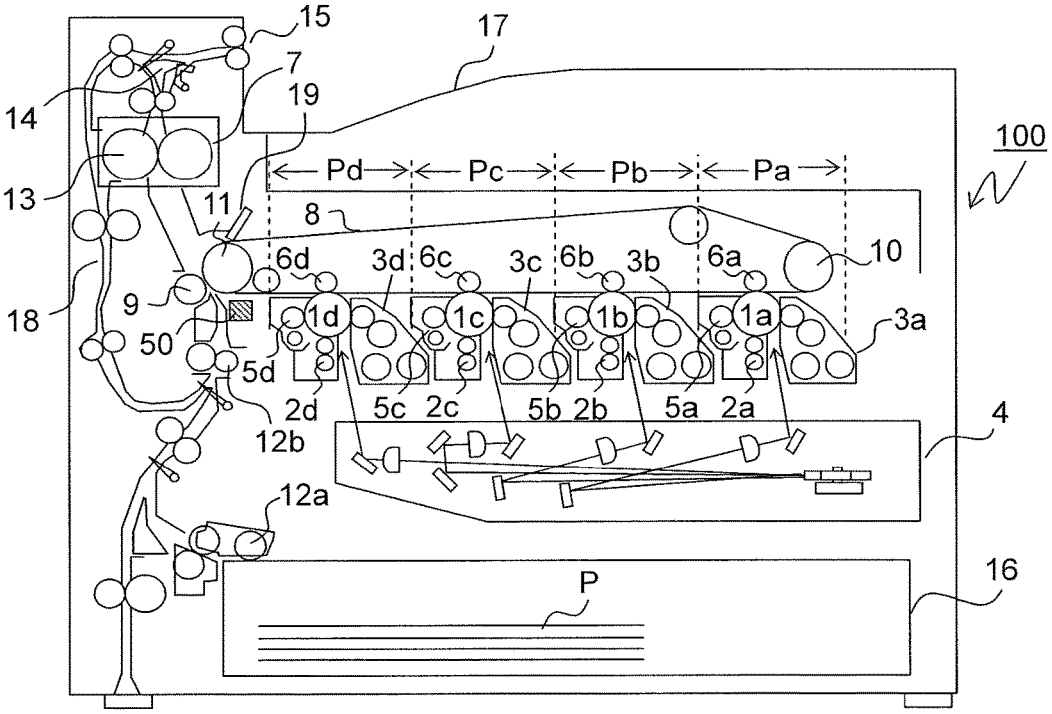
FIG. 1 is a schematic sectional view of a color printer incorporating an integrated sensor according to a first embodiment of the present disclosure.

FIG. 1 is a schematic sectional view of an image forming apparatus incorporating an integrated sensor 50 according to a first embodiment of the present disclosure, here showing a tandem-type color printer. In the main body of the color printer (image forming apparatus) 100, four image forming portions Pa, Pb, Pc, and Pd are arranged in this order from the upstream side (the right side in FIG. 1) of an intermediate transfer belt (toner image carrying member) 8 in its traveling direction. These image forming portions Pa to Pd are provided to correspond to images of four different colors (cyan, magenta, yellow, and black) respectively, and sequentially form cyan, magenta, yellow, and black images respectively, each through the processes of electrostatic charging, exposure to light, image development, and image transfer.

In these image forming portions Pa to Pd, there are respectively arranged photosensitive drums (electrostatic latent image carrying members) 1*a*, 1*b*, 1*c*, and 1*d* that carry visible images (toner images) of the different colors. Moreover, the intermediate transfer belt 8 that rotates in the clockwise direction in FIG. 1 is arranged next to the image forming portions Pa to Pd.

When image data is fed in from a host device such as a personal computer, first, by charging devices 2*a* to 2*d*, the surfaces of the photosensitive drums 1*a* to 1*d* are electrostatically charged uniformly. Then, through irradiation by an exposing device 4 with light based on the image data, electrostatic latent images based on the image data are formed on the photosensitive drums 1*a* to 1*d* respectively. The developing devices 3*a* to 3*d* are charged with predetermined amounts of two-component developer (hereinafter, also referred to simply as developer) containing magnetic carrier and toner of different colors, namely cyan, magenta, yellow, and black respectively, which is fed from toner containers (unillustrated). The toner contained in the developer is fed from the developing devices 3*a* to 3*d* to the photosensitive drums 1*a* to 1*d* having the electrostatic latent images formed on them, and electrostatically attaches to them. Thereby, toner images are formed based on the electrostatic latent images formed by exposure to light from the exposing device 4.

Then, an electric field is applied, by primary transfer rollers 6*a* to 6*d*, between the primary transfer rollers 6*a* to 6*d* and the photosensitive drums 1*a* to 1*d* with a predetermined transfer voltage, and the cyan, magenta, yellow, and black toner images on the photosensitive drums 1*a* to 1*d* are primarily transferred to the intermediate transfer belt 8, which is wound around a driving roller 11 and a following roller 10. Toner and the like that remain on the surfaces of the photosensitive drums 1*a* to 1*d* after primary transfer are removed by cleaning devices 5*a* to 5*d*.

Transfer sheets P to which toner images are to be transferred are stored in a sheet cassette 16 arranged in a lower part inside the color printer 100. A transfer sheet P is conveyed, via a sheet feeding roller 12*a* and a registration roller pair 12*b*, with predetermined timing to a nip (secondary transfer nip) between a secondary transfer roller 9, which is arranged next to the intermediate transfer belt 8, and the intermediate transfer belt 8. At the secondary transfer nip, the toner images on the surface of the intermediate transfer belt 8 are transferred to the sheet P. After the transfer, a belt cleaning device 19 removes toner left behind on the intermediate transfer belt 8. The transfer sheet P having the toner images secondarily transferred to it is conveyed to a fixing portion 7.

The transfer sheet P conveyed to the fixing portion 7 is then heated and pressed there by a fixing roller pair 13 so that the toner images are fixed to the surface of the transfer sheet P to form a predetermined full-color image. The transfer sheet P having the full-color image formed on it is, as it is (or after being distributed by a branching portion 14 into a reverse conveyance passage 18 and having images formed on both sides of it), discharged via a discharge roller pair 15 onto a discharge tray 17.

Figure 2:
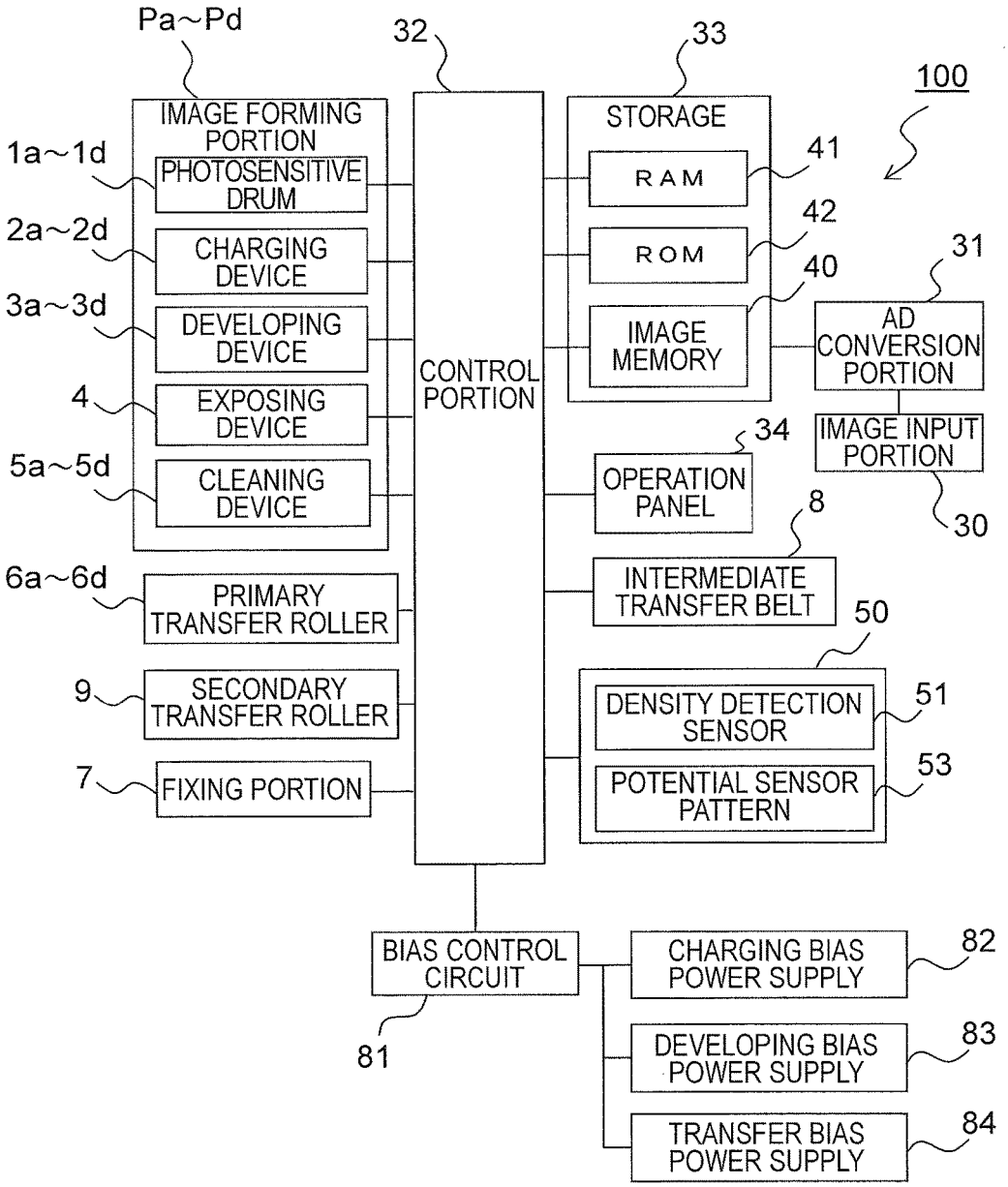
FIG. 2 is a block diagram showing controlling channels in the color printer according to the first embodiment of the present disclosure.

FIG. 2 is a block diagram showing controlling channels in the color printer 100 according to this embodiment. Such components as find their counterparts in FIG. 1 are identified by the same reference signs, and no overlapping description will be repeated. The color printer 100 includes the image forming portions Pa to Pd, an image input portion 30, an AD conversion portion 31, a control portion 32, a storage 33, an operation panel 34, the fixing portion 7, the intermediate transfer belt 8, the integrated sensor 50, a bias control circuit 81, and the like.

The image input portion 30 is a receiver portion which receives image data transmitted from a host device such as a personal computer or the like. The image signal received in the image input portion 30 is converted into a digital signal in the AD conversion portion 31, and is then fed out to an image memory 40 in the storage 33.

The storage 33 includes the image memory 40, RAM 41, and ROM 42. The image memory 40 stores the image signal fed in from the image input portion 30 and then converted into a digital signal in the AD conversion portion 31, and feeds it out to the control portion 32. The RAM 41 and the ROM 42 store processing programs, processed data, and the like for the control portion 32.

In the RAM 41 (or ROM 42), there are stored data and the like required for toner supply control, T/C correction control, and density correction control, of which the last two will be described later.

The operation panel 34 is composed of an operation portion which includes a plurality of operation keys and a display portion which displays setting conditions and the status of the apparatus (none of these is illustrated), and permits a user to make settings for printing conditions and the like.

The control portion 32 is, for example, a central processing unit (CPU), and generally controls, according to set programs, the image input portion 30, the image forming portions Pa to Pd, the fixing portion 7, conveyance of the sheets P from the sheet cassette 16 (see FIG. 1), and the like, and also converts an image signal fed in from the image input portion 30 into image data through variable magnification processing or gradation processing as necessary. The exposing device 4 shines laser light based on the processed image data to form an electrostatic latent image on the photosensitive drum 1*a* to 1*d*.

The control portion 32 also has a function of performing density correction for each color. This is achieved in the following manner. When a mode (hereinafter, referred to as a calibration mode) for properly setting image densities for different colors is set through key operation or the like on the operation panel 34, the control portion 32 receives an output signal from a density detection sensor 51, which will be described later, of the integrated sensor 50, and determines the density of a reference image based on the density data stored in the storage 33 to compare it with a previously set reference density with the intention of adjusting the developing biases of the developing devices 3*a* to 3*d*. Here, the calibration mode may be set automatically when the power to the color printer 100 is turned on or when image formation on a predetermined number of sheets is completed.

The bias control circuit 81 is connected to a charging bias power supply 82, a developing bias power supply 83, and a transfer bias power supply 84, and serves to operate these power supplies according to an output signal from the control portion 32. These power supplies apply predetermined biases, according to a control signal from the bias control circuit 81, to the charging devices 2*a* to 2*d*, the developing devices 3*a* to 3*d*, and the primary transfer rollers 6*a* to 6*d* and the secondary transfer roller 9 respectively.

The integrated sensor 50 is composed of the density detection sensor 51, a sensor board 52 (see FIG. 3) on which the density detection sensor 51 is mounted, and a potential sensor pattern 53 provided on the sensor board 52. The density detection sensor 51 and the potential sensor pattern 53 each transmit to the control portion 32 an output signal that reflects the result of detection. As shown in FIG. 1, the integrated sensor 50 is arranged on the downstream side of the image forming portion Pd, which is arranged on the most downstream side in the traveling direction of the intermediate transfer belt 8, and on the upstream side of the second transfer roller 9. That is, the integrated sensor 50 requires that the distance from the integrated sensor 50 to a measurement target be strictly defined, and is thus arranged at such a position as to face the driving roller 11, where the distance from the integrated sensor 50 to the surface of the intermediate transfer belt 8 varies little.

The integrated sensor 50 may be arranged at another position as long as it can detect a reference image formed on the intermediate transfer belt 8; however, when, for example, the integrated sensor 50 is arranged on the downstream side of the secondary transfer roller 9, the time taken after a reference image is transferred to the intermediate transfer belt 8 until density detection and potential detection are performed may be longer, and also, the surface condition of the reference image may change as a result of the reference image making contact with the secondary transfer roller 9. Thus, the integrated sensor 50 is preferably arranged near the downstream side of the image forming portion Pd arranged on the most downstream side.

Figure 3:
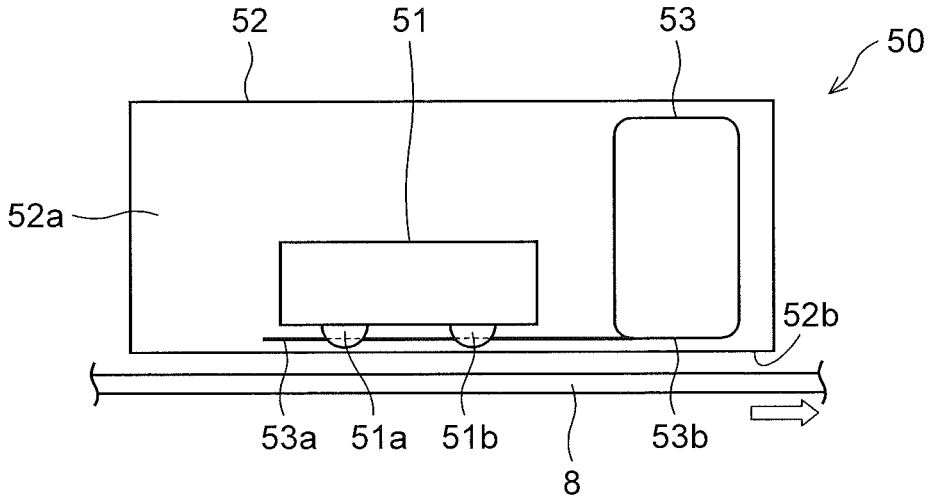
FIG. 3 is a diagram showing the structure of an integrated sensor according to the first embodiment of the present disclosure.

As shown in FIG. 3, the density detection sensor 51 is a sensor which detects the density of a reference image (toner image) formed on the intermediate transfer belt 8, and includes a light emitting portion 51*a* which emits light toward the intermediate transfer belt 8 and a light receiving portion 51*b* which receives the reflected light. The density detection sensor 51 is mounted on a sensor mounting surface 52*a* such that the optical path from the light emitting portion 51*a* to the light emitting potion 51*b* is parallel to the sensor mounting surface 52*a* of the sensor board 52. The light emitting portion 51*a* and the light receiving portion 51*b* are arranged near one edge 52*b* of the sensor board 52, which is arranged opposite the intermediate transfer belt 8, to be arranged close to the intermediate transfer belt 8.

Figure 4:
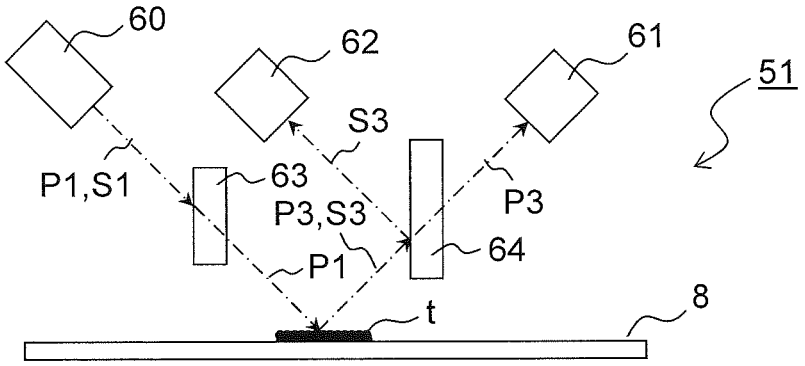
FIG. 4 is a diagram showing an outline of a configuration of the density detection sensor of the integrated sensor according to the first embodiment of the present disclosure.

The light emitting portion 51*a* is provided with a light emitting element (for example, an LED) 60 (see FIG. 4)

which irradiates the surface of the intermediate transfer belt 8 with measurement light. The light receiving portion 51*b* is provided with a first light receiving element 61 and a second light receiving element 62 (see FIG. 4) which receive the light reflected from the intermediate transfer belt 8. As shown in FIG. 4, between the light emitting element 60 and the intermediate transfer belt 8, a polarizing filter 63 is arranged, and this polarizing filter 63 transmits p-polarized light alone. On the other hand, between the second light receiving element 62 and the intermediate transfer belt 8, a polarizing beam splitter prism 64 is arranged, and this polarizing beam splitter prism 64 transmits p-polarized light to feed it to the first light receiving element 61 while reflecting s-polarized light to feed it to the second light receiving element 62. The light emitting element 60 is arranged at a predetermined angle relative to the surface of the intermediate transfer belt 8.

Suppose that a sufficient amount (proper amount) of toner has been transferred to the intermediate transfer belt 8. Then, when measurement light is shone on the intermediate transfer belt 8 from the light emitting element 60, as shown in FIG. 4, of the measurement light including p-polarized light P1 and s-polarized light S1, the light S1 is intercepted by the polarizing filter 63, and the light P1 alone strikes the intermediate transfer belt 8 through the polarizing filter 63. The light P1 is not transmitted through toner t to reach the surface of the intermediate transfer belt 8, but is wholly reflected on the surface of the toner t.

This reflected light is split into regular reflection light P3 and irregular reflection light S3 by the polarizing beam splitter prism 64. The regular reflection light P3 is received by the first light receiving element 61 and the irregular reflection light S3 is received by the second light receiving element 62. Then, the first and second light receiving elements 61 and 62 perform photoelectric conversion on the received light to output first and second output signals respectively. The first and second output signals are subjected to A/D conversion, and are then transmitted to the control portion 32 (see FIG. 2). In the control portion 32, the difference between the first and second output signals is calculated as a measurement output value, and the measurement output value is corrected based on the reference value (the difference between the first and second output signals obtained when no toner is attached to the intermediate transfer belt 8) to yield a corrected output value. That is, the corrected output value, which equals one when no toner is attached, is calculated by dividing the measurement output value by the reference value.

When the amount of toner in the toner image transferred to the intermediate transfer belt 8 is insufficient, part of the light P1 incident on the toner t is reflected on the surface of the toner t, and the remaining part is transmitted through the toner t. The light transmitted through the toner t is then reflected on the surface of the intermediate transfer belt 8. This reduces light received by the first light receiving element 61 and the second light receiving element 62, and thus reduces the measurement output value and the corrected output value.

As shown in FIG. 3, the potential sensor pattern 53 is a sensor which detects the potential of a reference image (toner image) formed on the intermediate transfer belt 8, and is composed of an antenna portion 53*a* constituted by a metal conductor and detecting the potential of the reference image (toner image) and a circuit portion 53*b*. The antenna portion 53*a* is formed to extend in the conveyance direction of the intermediate transfer belt 8 (in the rightward direction in FIG. 3), and is arranged between the one edge 52*b* of the sensor board 52 and the density detection sensor 51. The antenna portion 53*a* transmits to the circuit portion 53*b* a detection signal corresponding to the surface potential on the intermediate transfer belt 8.

Figure 5:
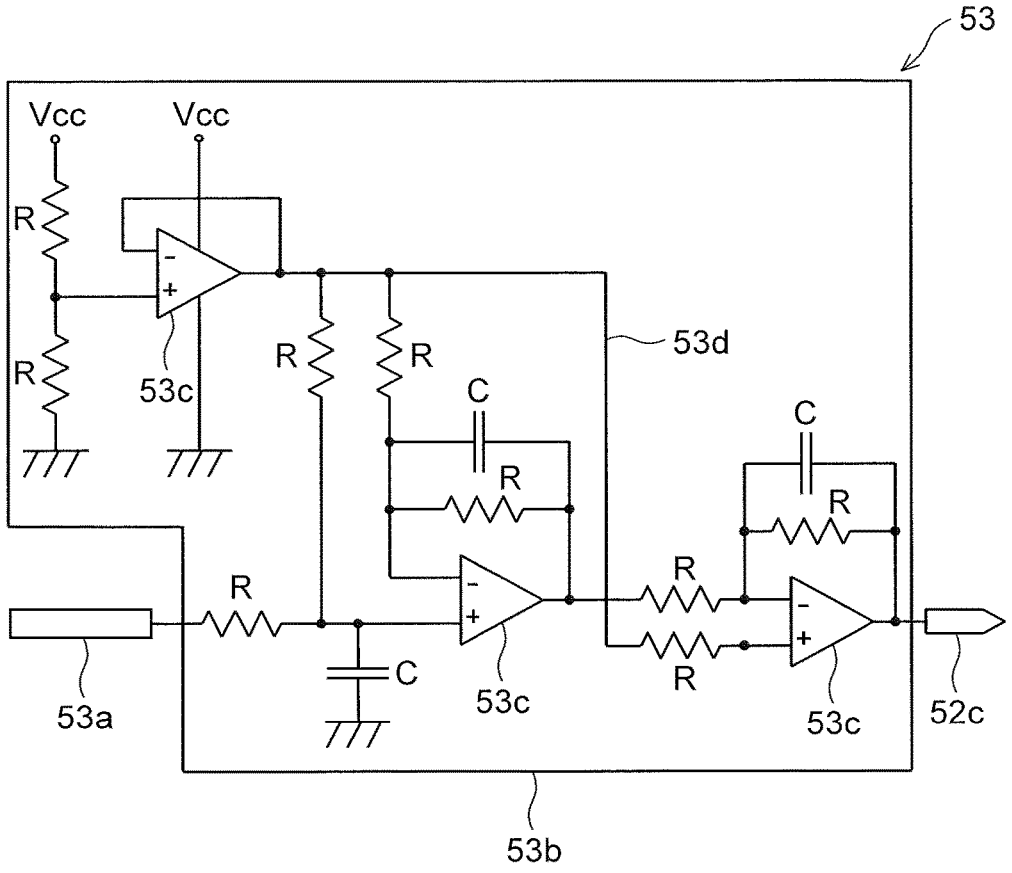
FIG. 5 is a diagram showing a circuit configuration of a potential sensor pattern of the integrated sensor according to the first embodiment of the present disclosure.

As shown in FIG. 5, the circuit portion 53*b* is composed solely of resistors R, capacitors C, amplifiers 53*c*, and metal conductors 53*d*. The circuit portion 53*b* converts a signal from the antenna portion 53*a* into an output signal, and outputs it to the control portion 32 via an output portion 52*c* arranged on the sensor board 52.

The potential sensor pattern 53 outputs to the control portion 32 an output signal corresponding to the surface potential on the intermediate transfer belt 8 in a formation region where a reference image is formed and an output signal corresponding to the surface potential on the intermediate transfer belt 8 in a blank region where no reference image is formed. The control portion 32 detects the voltage potential of the reference image based on the relative value between these output signals.

Figure 6:
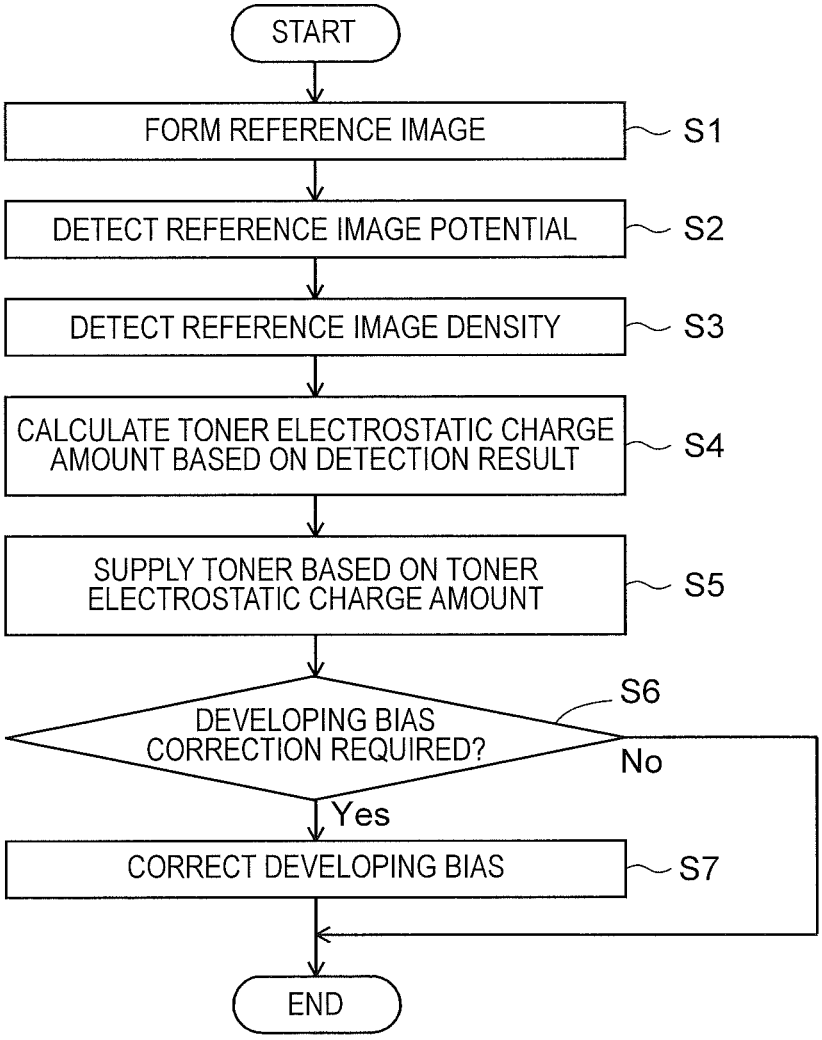
FIG. 6 is a flow chart showing a control flow of the color printer according to the first embodiment of the present disclosure.

Now, a description will be given of T/C correction control and density correction control in the color printer 100 according to this embodiment. Here, T/C represents the ratio of toner to carrier. As shown in FIG. 6, when the calibration mode is started, in the image forming portions Pa to Pd, reference images are formed on the photosensitive drums 1*a* to 1*d*, and are then transferred to the intermediate transfer belt 8 (step S1).

Figure 7:
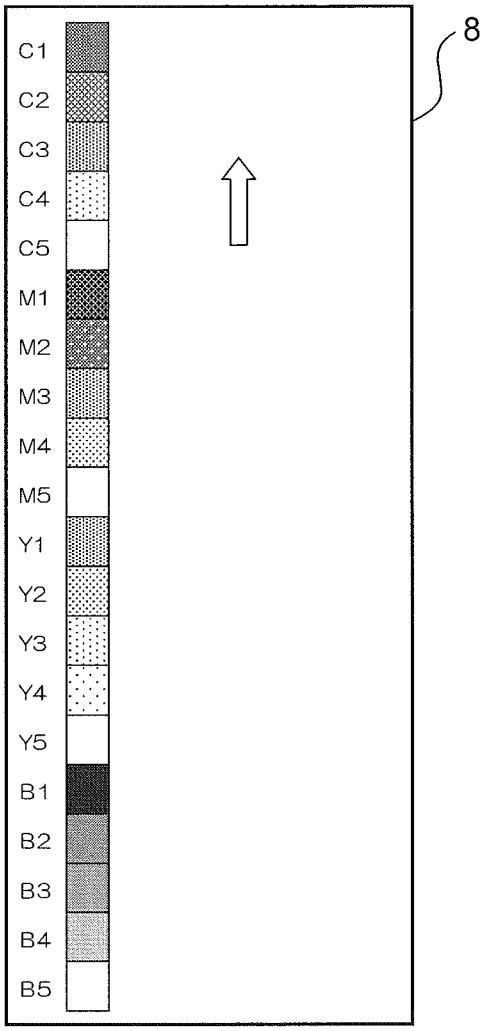
FIG. 7 is a diagram showing an example of reference images for T/C correction and density correction.

FIG. 7 is a diagram showing an example of reference images for T/C correction and density correction. On the intermediate transfer belt 8, rectangular reference images C1 to C5, M1 to M5, Y1 to Y5, and B1 to B5 of different colors, namely cyan, magenta, yellow, and black, are formed in a row along the traveling direction of the intermediate transfer belt 8 (the upward direction in FIG. 8, the sub-scanning direction). The cyan reference images formed by the photosensitive drum 1*a* are reference images C1 to C5 of five grades of density formed, in the traveling direction, in order from the image (C1) with the highest density to the image (C5) with the lowest density. The magenta reference images M1 to M5, the yellow reference images Y1 to Y5, and the black reference images B1 to B5 are formed in similar manners to the reference images C1 to C5. Between the reference images C5 and M1, between the reference images M5 and Y1, and between the reference images of Y5 and B1, there can be formed a blank region where no reference image is formed.

Then, at step S2, the potential of the reference image C1 is detected by the potential sensor pattern 53. Here, as described above, the potential of the reference image C1 is detected based on the relative value between the surface potential on the intermediate transfer belt 8 in the formation region where the reference image C1 is formed and the surface potential on the intermediate transfer belt 8 in the blank region where no reference image is formed.

At step S3, the densities of the reference images C1 to C5 are detected by the density detection sensor 51.

At step S4, by the control portion 32, based on the result of detection of the potential of the reference image C1 and the result of detection of the density of the reference image C1, the amount of electrostatic charge of toner is calculated.

At step S5, by the control portion 32, with reference to a table in which the amount of electrostatic charge of toner is associated with the amount of supply of toner required to correct the T/C to the previously set value, a predetermined amount of cyan toner is supplied to the developing device 3*a*.

At step S6, by the control portion 32, based on the result of detection of the densities of the reference images C1 to C5, whether or not correction of the developing bias applied to the developing device 3*a* is required is checked. Specifically, by comparing the result of detection of the densities of the reference images C1 to C5 with the previously set reference density, the required correction amount (the deviation in density) is calculated. Then, by the control portion 32, the calculated required correction amount is compared with the amount of the image density corrected through T/C correction at step S5, and thereby whether or not correction of the developing bias applied to the developing device 3*a* is required is checked.

When, at step S6, it is determined that correction of the developing bias is required, at step S7, by the control portion 32, the developing bias of the developing device 3*a* is corrected, and this ends the process. The amount by which the developing bias is corrected at step S7 is determined based on the value obtained by subtracting the amount by which the image density is corrected through T/C correction at step S5 from the required correction amount (the deviation in density) calculated at step S6.

On the other hand, when, at step S6, it is determined that no correction of the developing bias is required (that is, when the required correction amount calculated at step S6 equals the amount by which the image density has been corrected through T/C correction at step S5), the process ends without the developing bias of the developing device 3*a* being corrected.

Also for each of the magenta, yellow, and black developing devices 3*b* to 3*d*, the control through steps S2 to S7 is performed concurrently with that for the cyan developing device 3*a*.

In this embodiment, as described above, on the sensor board 52 on which the density detection sensor 51 that detects the density of a toner image is mounted, the potential sensor pattern 53 that detects the potential of the toner image is provided as well, and thus it is possible, with one sensor (the integrated sensor 50), to achieve detection of both the density and the potential of a toner image. This helps achieve space saving as to the space necessary for fitting a sensor and helps improve the efficiency of fitting work. Considering that the density detection sensor 51 that detects the density of a toner image and the sensor (potential sensor pattern) that detects the potential of the toner image require high positioning accuracy, the integrated sensor 50 according to this embodiment is particularly effective because, when the density detection sensor 51 is positioned, the potential sensor pattern 53 is also positioned together.

As described above, the potential sensor pattern 53 is composed only of the resistors R, the capacitors C, the amplifiers 53*c*, and the metal conductors 53*d*. This makes it possible to detect the potential of a toner image with an inexpensive configuration.

As described above, the light emitting portion 51*a* and the light receiving portion 51*b* of the density detection sensor 51 are arranged near the one edge 52*b* of the sensor board 52 such that the optical path from the light emitting portion 51*a* to the light receiving portion 51*b* is parallel to the sensor mounting surface 52*a* of the sensor board 52. The antenna portion 53*a* of the potential sensor pattern 53 is arranged between the one edge 52*b* of the sensor board 52 and the density detection sensor 51. This makes it possible to arrange the antenna portion 53*a* near the intermediate transfer belt 8, and thus to improve the reception sensitivity of the antenna portion 53*a*.

As described above, the potential sensor pattern 53 detects the potential of a reference image based on the relative value between the surface potential on the intermediate transfer belt 8 in the formation region where a reference image is formed and the surface potential on the intermediate transfer belt 8 in the blank region where no reference image is formed. This eliminates the need for the potential sensor pattern 53 to detect the absolute value of the potential of the reference image, and thus it is possible to give the potential sensor pattern 53 a simple configuration.

As described above, the control portion 32 corrects the developing biases applied to the developing devices 3*a* to 3*d* based on the result of detection by the density detection sensor 51. That is, the density detection sensor 51 doubles as a sensor that detects the density of a reference image when the developing biases applied to the developing devices 3*a* to 3*d* are corrected. This makes it possible to obtain the integrated sensor 50 simply by adding the potential sensor pattern 53 to the sensor board 52 of the density detection sensor 51 for correction of the developing biases applied to the developing devices 3*a* to 3*d*.

As described above, the control portion 32 corrects the T/Cs in the developing devices 3*a* to 3*d* to the previously set values based on the result of detection by the density detection sensor 51 and the result of detection by the potential sensor pattern 53. This makes it possible to easily correct the T/Cs in the developing devices 3*a* to 3*d* to the previously set values.

Second Embodiment

Figure 8:
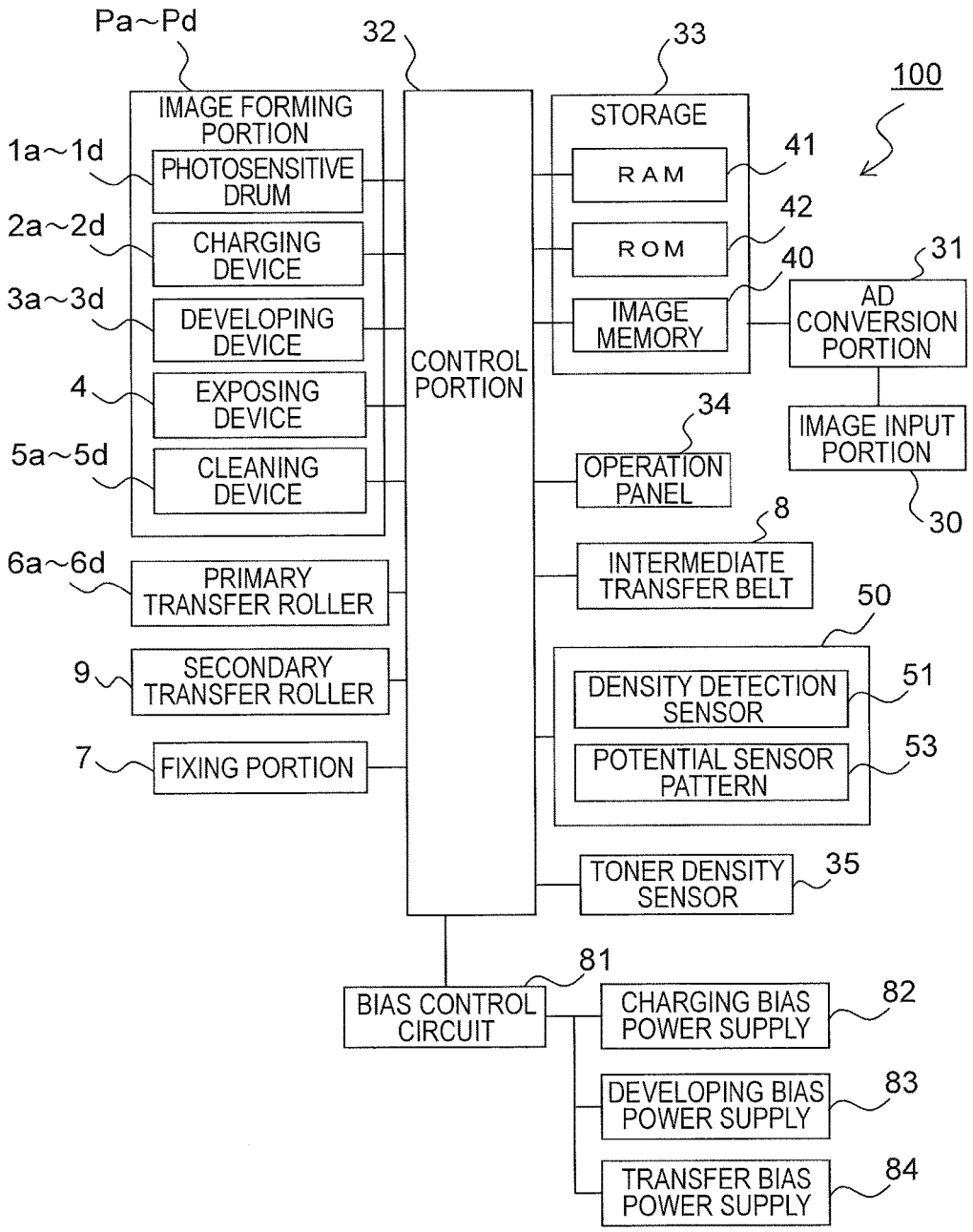
FIG. 8 is a block diagram showing controlling channels of a color printer according to a second embodiment of the present disclosure.

As shown in FIG. 8, a color printer 100 according to a second embodiment of the present disclosure further includes a toner density sensor (toner density detecting portion) 35. In RAM 41 (or ROM 42), the output value or the like of the toner density sensor 35 is stored.

The toner density sensor 35 is arranged in a stirring portion which stirs developer in the developing devices 3*a* to 3*d*, and detects the ratio of toner to carrier (the T/C) in the developing devices 3*a* to 3*d*.

As the toner density sensor 35, a magnetic permeability sensor is used that detects the magnetic permeability of two-component developer in the developing devices 3*a* to 3*d*. In this embodiment, a configuration is adopted where the toner density sensor 35 detects the magnetic permeability of the developer, and outputs to the control portion 32 a voltage value corresponding to the result of detection. The output value of the toner density sensor 35 varies with the T/C; specifically, the higher the T/C is, the higher the proportion of toner, through which magnetism does not permeate, is, and thus the lower the output value is. On the other hand, the lower the T/C is, the higher the proportion of carrier, through which magnetism permeates, is, and thus the higher the output value is.

The control portion 32 determines the amount of toner supplied to the developing devices 3*a* to 3*d* (the drive time of a toner supply motor (unillustrated)) based on the output value of the toner density sensor 35, and transmits a control signal to a toner supply motor (unillustrated) to drive it for a predetermined time (or a predetermined number of turns of rotation).

Specifically, the control portion 32 detects the T/C in the developing devices 3*a* to 3*d* based on the output value of the toner density sensor 35. The control portion 32 calculates, based on the detected T/C, the amount (second correction value) of toner supplied to the developing devices 3*a* to 3*d* to correct the T/C to a previously set value. The control portion 32 also calculates the amount of electrostatic charge of toner based on the result of detection by the density detection sensor 51 and the potential sensor pattern 53, and calculates the amount (first correction value) of toner supplied to the developing devices 3*a* to 3*d* to correct the T/C to the previously set value. Then, the control portion 32 repeatedly performs detection by the toner density sensor 35 and detection by the density detection sensor 51 and the potential sensor pattern 53 until the first correction value and the second correction value equal each other. When the first correction value and the second correction value equal each other, the control portion 32 corrects the T/C in the developing devices 3*a* to 3*d* to the previously set value.

Figure 9:
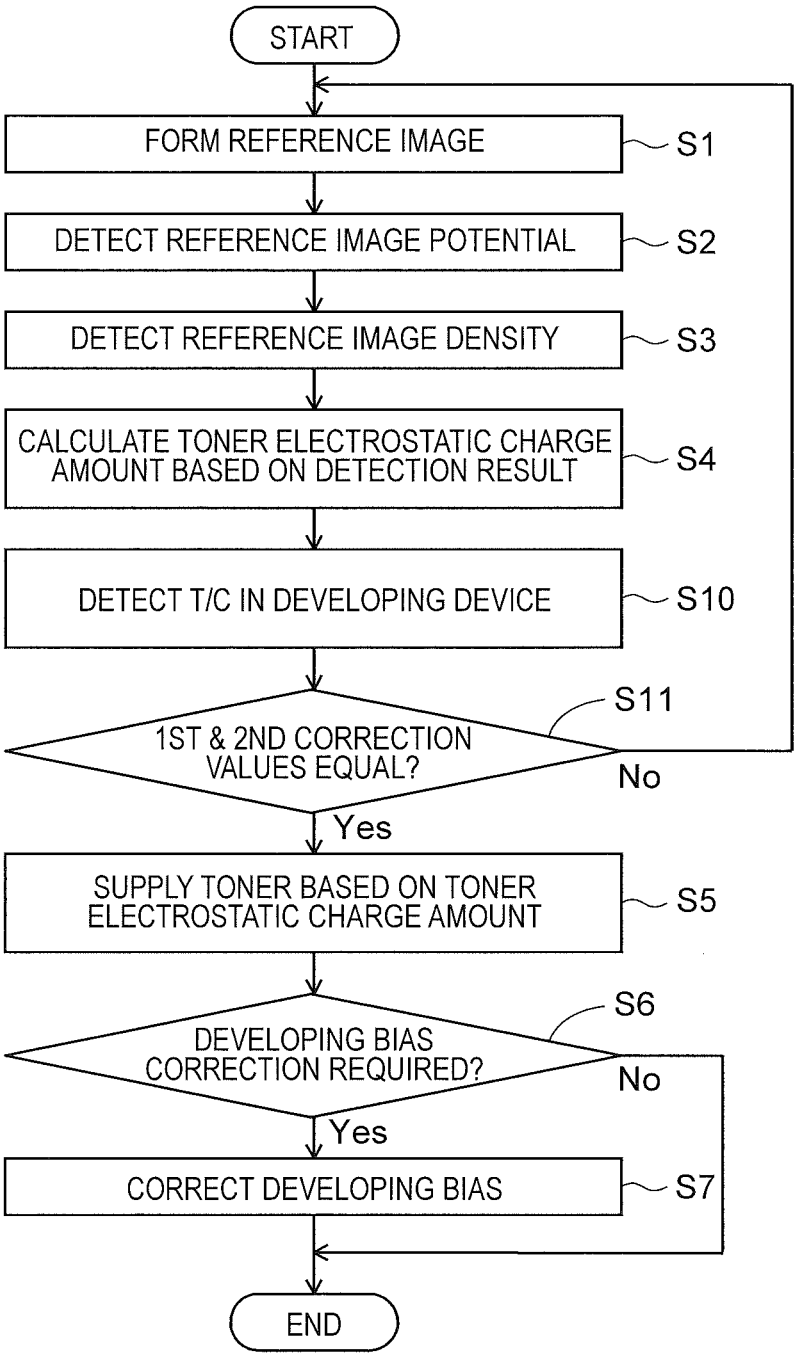
FIG. 9 is a flow chart showing a control flow of the color printer according to the second embodiment of the present disclosure.

Next, a description will be given of T/C correction control and density correction control in the color printer 100 according to this embodiment. In this embodiment, as shown in FIG. 9, after step S4, the flow proceeds to step S10 and then, after having gone through the processes of steps S10 and S11, proceeds to step S5 to perform the processes of steps S5 to S7. Steps S1 to S4 and steps S5 to S7 are similar to those in the above-described first embodiment.

At step S10, by the toner density sensor 35, the T/C in the developing devices 3*a* to 3*d* is detected.

At step S11, by the control portion 32, based on the detected T/C, the amount (second correction value) of toner to be supplied to the developing devices 3*a* to 3*d* to correct the T/C to the previously set value is calculated. Also by the control portion 32, based on the amount of electric charge of toner calculated from the result of detection by the density detection sensor 51 and the potential sensor pattern 53, the amount (first correction value) of toner to be supplied to the developing devices 3*a* to 3*d* to correct the T/C to the previously set value is calculated. Then, by the control portion 32, it is checked whether or not the first correction value and the second correction value equal each other.

When, at step S11, it is found that the first correction value and the second correction value do not equal each other, steps S1 to S4, S10, and S11 are repeated.

When, at step S11, it is found that the first correction value and the second correction value equal each other, the flow proceeds to step S5, where, by the control portion 32, based on the first correction value and the second correction value, a predetermined amount of toner is supplied to the developing devices 3*a* to 3*d*.

Otherwise, the structure and the control flow in the second embodiment are similar to those in the above-described first embodiment.

In this embodiment, as described above, the control portion 32 performs detection by the density detection sensor 51 and the potential sensor pattern 53 and detection by the toner density sensor 35 until the first correction value based on the result of detection by the density detection sensor 51 and the potential sensor pattern 53 and the second correction value based on the result of detection by the toner density sensor 35 equal each other, and corrects the T/C in the developing devices 3*a* to 3*d* to the previously set value when the first correction value and the second correction value equal each other. This helps reduce the errors in the detection by the integrated sensor 50 and by the toner density sensor 35.

Otherwise, the effects of the second embodiment are similar to those of the above-described first embodiment.

It should be understood that the embodiments disclosed herein are in every aspect illustrative and not restrictive. The scope of the present disclosure is defined not by the description of embodiments given above but by the appended claims, and encompasses many modifications and variations made in the sense and scope equivalent to those of the claims.

For example, the present disclosure is applicable, not only to tandem-type color printers like the one shown in FIG. 1, but also to various image forming apparatuses provided with a toner image carrying member, examples including monochrome printers, color copiers, monochrome copiers, digital multifunction peripherals, facsimile machines, and the like.

Although the above-described embodiments deal with an example where the integrated sensor 50 detects the density and the potential of a toner image formed on the intermediate transfer belt 8, this is in no way meant to limit the present disclosure. The integrated sensor 50 may detect the density and the potential of a toner image formed on the photosensitive drums (toner image carrying members) 1*a* to 1*d*.

Although the above-described second embodiment deals with an example where the control portion 32 repeatedly performs detection by the toner density sensor 35 and detection by the density detection sensor 51 and the potential sensor pattern 53 until the first correction value and the second correction value equal each other, and corrects the T/C in the developing devices 3*a* to 3*d* to the previously set value when the first correction value and the second correction value equal each other, this is in no way meant to limit the present disclosure. The control portion 32 may repeatedly perform detection by the toner density sensor 35 and detection by the density detection sensor 51 and the potential sensor pattern 53 until the difference between the first correction value and the second correction value is equal to or lower than a predetermined value, and correct the T/C in the developing devices 3*a* to 3*d* to the previously set value when the difference between the first correction value and the second correction value is equal to or lower than the predetermined value.

Although the above-described embodiments deal with an example where the image density is corrected by adjusting the developing bias, this is in no way meant to limit the present disclosure. For example, the image density may be corrected by adjusting the potential of electrostatic charge on the photosensitive drums 1*a* to 1*d* or the amount of exposure by the exposing device 4.

What is claimed is:

1. An integrated sensor comprising:

a density detection sensor which detects a density of a toner image formed on a toner image carrying member;

a sensor board on which the density detection sensor is mounted; and a potential sensor pattern provided on the sensor board, the potential sensor pattern detecting a potential of the toner image, wherein the potential sensor pattern is composed solely of at least one resistor, at least one capacitor, at least one amplifier, and at least one metal conductor, the density detection sensor includes a light emitting portion and a light receiving portion, the light emitting portion and the light receiving portion are arranged near one edge of the sensor board such that an optical path from the light emitting portion to the light receiving portion is parallel to a sensor mounting surface of the sensor board, the potential sensor pattern includes an antenna portion which is constituted by the metal conductor and which detects the potential of the toner image, and the antenna portion is arranged between the one edge of the sensor board and the density detection sensor.

2. An image forming apparatus comprising:
the integrated sensor of claim 1; and
the toner image carrying member.

3. The image forming apparatus of claim 2, wherein
the potential sensor pattern detects a potential of a reference image based on a relative value between a surface potential on the toner image carrying member in a formation region where the reference image is formed and a surface potential on the toner image carrying member in a blank region where no reference image is formed.

4. The image forming apparatus of claim 2, further comprising:
an electrostatic latent image carrying member on which an electrostatic latent image is formed;
a developing device which forms a toner image based on the electrostatic latent image by feeding toner to the electrostatic latent image carrying member; and
a control portion which corrects a developing bias applied to the developing device based on a result of detection, by the density detection sensor, of a density of the reference image formed on the toner image carrying member, wherein
the toner image carrying member is an intermediate transfer belt to which the toner image formed on the electrostatic latent image carrying member is transferred.

5. An image forming apparatus comprising:
an integrated sensor including:
a density detection sensor which detects a density of a toner image formed on a toner image carrying member;
a sensor board on which the density detection sensor is mounted; and
a potential sensor pattern provided on the sensor board, the potential sensor pattern detecting a potential of the toner image;
the toner image carrying member;
an electrostatic latent image carrying member on which an electrostatic latent image is formed;
a developing device which forms a toner image based on the electrostatic latent image by feeding toner to the electrostatic latent image carrying member; and
a control portion which corrects a developing bias applied to the developing device based on a result of detection, by the density detection sensor, of a density of the reference image formed on the toner image carrying member, wherein
the toner image carrying member is an intermediate transfer belt to which the toner image formed on the electrostatic latent image carrying member is transferred,
in the developing device, two-component developer containing toner and carrier is stored, and
the control portion corrects a ratio of toner to carrier in the developing device to a previously set value based on a result of detection by the density detection sensor and a result of detection by the potential sensor pattern.

6. The image forming apparatus of claim 5, wherein
the potential sensor pattern is composed solely of at least one resistor, at least one capacitor, at least one amplifier, and at least one metal conductor.

7. The image forming apparatus of claim 6, wherein
the density detection sensor includes a light emitting portion and a light receiving portion,
the light emitting portion and the light receiving portion are arranged near one edge of the sensor board such that an optical path from the light emitting portion to the light receiving portion is parallel to a sensor mounting surface of the sensor board,
the potential sensor pattern includes an antenna portion which is constituted by the metal conductor and which detects the potential of the toner image, and
the antenna portion is arranged between the one edge of the sensor board and the density detection sensor.

8. The image forming apparatus of claim 5, wherein
the potential sensor pattern detects a potential of a reference image based on a relative value between a surface potential on the toner image carrying member in a formation region where the reference image is formed and a surface potential on the toner image carrying member in a blank region where no reference image is formed.

9. The image forming apparatus of claim 5, further comprising:
a toner density detecting portion which detects the ratio of toner to carrier in the developing device, wherein
the control portion
performs detection by the density detection sensor and the potential sensor pattern and detection by the toner density detecting portion until a difference between a first correction value with which to correct the ratio of toner to carrier in the developing device to the previously set value based on the result of detection by the density detection sensor and the potential sensor pattern and a second correction value with which to correct the ratio of toner to carrier in the developing device to the previously set value based on a result of detection by the toner density detecting portion is equal to or lower than a predetermined value, and
corrects the ratio of toner to carrier in the developing device to the previously set value when the difference between the first correction value and the second correction value is equal to or lower than the predetermined value.

* * * * *